United States Patent [19]

Woznica

[11] 4,337,570

[45] Jul. 6, 1982

[54] ELECTRICAL FUSELINKS

[75] Inventor: Kazimierz W. Woznica, Corsley, England

[73] Assignee: Kenneth E. Beswick Limited, Frome, England

[21] Appl. No.: 212,370

[22] Filed: Dec. 3, 1980

[30] Foreign Application Priority Data

Dec. 3, 1979 [GB] United Kingdom ..... 7941695

[51] Int. Cl.[3] ..... H01H 69/02

[52] U.S. Cl. ..... 29/623; 29/429; 29/756

[58] Field of Search ..... 29/623, 429, 756; 337/290, 295, 159

[56] References Cited

U.S. PATENT DOCUMENTS

| | | | |
|---|---|---|---|
| 3,236,976 | 2/1966 | Rayno | 337/292 |
| 3,432,923 | 3/1966 | Feenan et al. | 29/623 |
| 3,885,303 | 5/1975 | Deelman | 29/623 |
| 4,023,264 | 5/1977 | Schmidt et al. | 337/295 X |
| 4,099,322 | 7/1978 | Tait | 29/623 |
| 4,205,431 | 6/1980 | Webe | 29/623 |

*Primary Examiner*—Leon Gilden

*Attorney, Agent, or Firm*—Brisebois & Kruger

[57] ABSTRACT

A fuse element for an electrical cartridge fuse comprises a fusible wire secured to opposite end zones of an insulating strip by metallic layers sprayed onto the end zones. The insulating strip has a slot therein between the end zones to prevent the fusible, central section of the wire from contacting the strip. The fuse element is disposed in an insulating barrel and the layers are soldered to end caps of the barrel to connect the fusible wire thereto. Fuse elements of this construction are produced by disposing a fusible wire along a continuous strip of insulating material formed at equally spaced intervals with slots and spraying the metallic layers onto the strip between the slots so as to adhere the fusible wire to the strip. Thereafter, the strip is severed at the zones between the slots so as to produce individual fuse elements. This method of manufacture facilitates the production of cartridge fuses utilizing small diameter fusible wires.

5 Claims, 6 Drawing Figures

ELECTRICAL FUSELINKS

BACKGROUND OF THE INVENTION

The present invention relates to electrical cartridge fuselinks for protecting electrical and electronic equipment and, more particularly, to cartridge fuselinks intended to rupture at low current values.

Cartridge fuselinks having low current ratings utilize fusible wires of extremely small diameter. In many instances, they are barely visible to the naked eye. Hence, they are difficult to handle and often comprise metals or alloys which are difficult to solder. To facilitate the manufacture of cartridge fuselinks having these small diameter fuse wires and improve their operational reliability, it is known to mount the fusible wire on an insulating support with its opposite ends electrically connected to conductive end portions of the support and then to assemble the fuse element thus formed with an insulating barrel or tube. The fuse element is disposed within the insulating barrel and its conductive end portions are electrically connected to metal end caps or terminals fastened to opposite ends of the barrel. A number of different constructions of this type are disclosed by the prior art, for example, U.S. Pat. Nos. 2,576,405 (C. L. M. McAlister), 3,348,007 and 3,568,122 (both issued to A. Urani), 3,530,505 (E. Salzer) and U.K. Pat. No. 768136 (Belling & Lee Ltd).

McAlister and the first of the Urani patents disclose fuse elements in which the insulating support is of approximately the same length as the insulating barrel and a short length of fusible wire is disposed diagonally across the support and is soldered between conductive layers on the support which extend from its opposite ends to adjacent the centre of the support. The fusible wire is prevented from contacting the support by an aperture or rebate therein. When the fuse element is assembled within an insulating barrel the conductive layers are soldered to the end caps. The second Urani patent describes an arrangement in which the insulating support is somewhat shorter than the insulating barrel and the conductive layers at opposite ends of the support are connected to the adjacent end caps on the barrel by lead wires soldered to the conductive layers and the end caps. Salzer discloses a more complicated construction in which the insulating support serially mounts a plurality of fusible wire sections interconnected by conductive ribbon sections on the support and connected to the end caps of the cartridge fuse by such ribbon sections. The fusible wire sections are welded to the conductive ribbons and the outer ribbons are soldered to the end caps. The Belling & Lee patent describes a fuse element in which a fusible wire is disposed along the length of an elongated insulating support of approximately the same length as the insulating barrel and is clamped to opposite ends of the support by means of metal clips which have longitudinally projecting tongues. An aperture in the centre of the support prevents the fusible section of the wire from contacting the support. The fuse element is positioned in an insulating barrel and the tongues at opposite ends of the support project through apertures in end caps attached to the barrel and are bent over and secured to the outside of the associated end caps by soldering or spot welding.

Other patents of generally background interest are U.S. Pat. No. 1,921,392 (F. C. La Mar) and German Pat. Nos. 368033 (W. Pudenz) and 426301 (N. Sandor).

The prior art constructions described above are all relatively expensive to manufacture and do not lend themselves to the mass production of cartridge fuselinks. It is an object of the present invention to provide a method of manufacturing cartridge fuselinks of the kind described which facilitates the use of mass production techniques and enables the production of a relatively inexpensive fuselink of novel construction.

SUMMARY OF THE INVENTION

The present invention consists in a method of manufacturing electrical cartridge fuselinks of the kind in which a fusible wire or other fusible member is mounted on an insulating support, between conductive end zones of the support, and the fuse element thus formed is disposed within an insulating barrel with the conductive end zones electrically connected to end caps or terminals of the barrel, characterized by the steps of disposing a fusible member along a strip of insulating material, adhering metallic layers to the fusible member and strip at spaced zones along the strip so as to attach the fusible member to the strip, and severing the fusible member and strip at the spaced attachment zones so as to produce fuse elements having fusible members attached at opposite ends to insulating supports by metallic layers.

The fuse elements produced by this invention may be mounted in insulating barrels or tubes. They may be approximately the same lengths as the barrels and the metallic layers at opposite ends of each fuse element may be soldered to the end caps or terminals of the associated barrel in order to produce a cartridge fuselink.

The metallic layers securing the fusible member in position are preferably produced by applying and hardening a layer or coating of a fluidized metallic material over the fusible member and strip. For example, the metallic layers may be applied by metal spraying or, alternatively, may be a metallic based electrically conductive adhesive which may be applied by screen printing or similar techniques. Prior to application of the metallic layers, the fuse member may be temporarily attached in position along the insulating strip by applying small amounts of drops of a quick drying adhesive substance in the zones whereat the fusible member is to be subsequently secured to the strip. The metallic material of the layers is preferably one which can be readily soldered so as to permit the fusible member to be soldered to electrically conductive end caps or terminals via the metallic layers.

Instead of a simple fusible wire, the fusible member may be a fusible wire carrying eutectic blobs, a spirally wound fusible wire supported by a non-conductive former, or a plated or coated wire member, each of which would produce a fuse element having different electrical characteristics.

The insulating strip may have rebates formed in one side or surface thereof between the attachment zones so as to preclude the fusible section of the fusible member from contacting the strip and affecting the characteristics of the fuse element. Alternatively, for this purpose, the insulating strip may be formed with openings between the attachment zones. The fusible member may be adhered to the strip by applying the metallic layers over the whole or nearly the whole lengths of the zones between the rebates or openings, and by controlling the lengths of the latter and the spaces between the layers, the resistance of the fuse element can be precisely determined.

This invention is particularly useful for mass producing cartridge fuselinks intended to rupture at low current values, for example, below 200 mA, whan a fusible wire is of very small diameter. The invention enables such small diameter fusible wires to be easily handled during the production process of such fuselinks. The fuse elements produced may be readily inserted into insulating barrels and be secured to the electrically conductive end caps or terminals of the barrels by soldering the metallic layers to the end caps. They may be inserted into the insulating barrels either manually or by automatic means.

The invention also consists in an electrical cartridge fuselink in which a fuse element comprising a fusible wire or other fusible member mounted on an insulating support, between conductive end zones of the support, is disposed within an insulating barrel with the conductive end zones electrically connected to end caps or terminals of the barrel, characterized in that the fusible member extends substantially along the lengths of the support and is secured thereto at opposite end zones of the support by metallic layers adhered to the fusible member and the support.

BRIEF DESCRIPTION OF THE DRAWINGS

In order that the invention may be more readily understood, reference will now be made to the accompanying drawings, in which.

DESCRIPTION OF THE PREFERRED EMBODIMENTS

Figure 1:
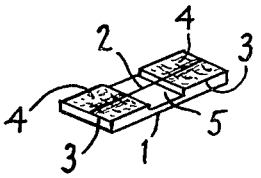
FIG. 1 is a perspective view of a fuse element manufactured by the invention.

Referring to FIG. 1 of the drawings the fuse element illustrated comprises an elongated insulating support 1 made from a strip of insulating material and having a fine fusible wire 2 extending along its length and attached to the support in spaced zones 3 at opposite ends of the latter. The wire 2 is adhered to the support by sprayed metal layers 4, the metal of these layers being one which can be readily soldered, for example, zinc. Between the zones 3, the insulating support is formed with a rebate 5 which prevents the central section of the fusible wire 2, which is intended to rupture in the event of an overload current, from contacting the support and affecting the characteristics of the fuse element. Moreover, the metal layers 4 extend for the full length of the zones or lands 3 so that the resistance of the fusible wire can be precisely determined by controlling the length of the rebate 5, and the length of the rebate can be altered for different fuse ratings.

To produce a cartridge fuselink, the fuse element shown in FIG. 1 is inserted into a suitable insulating barrel (not shown) and the sprayed metal layers 4 at opposite ends of the fuse element are connected by solder to end caps on the barrel, thereby electrically connecting the fusible wire to the end caps. It will be appreciated that the fuse element is easy to handle and assemble with the insulating barrel and end caps, and that the metal layers may be readily attached by solder to the end caps so as to produce the desired electrical connections.

Figure 2:
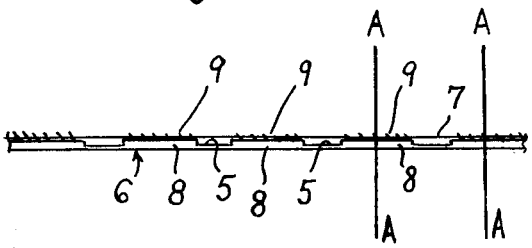
FIG. 2 is a side elevation of an assembly of an insulating strip and fusible wire illustrating one method of manufacturing the fuse element shown in FIG. 1.
Figure 3:
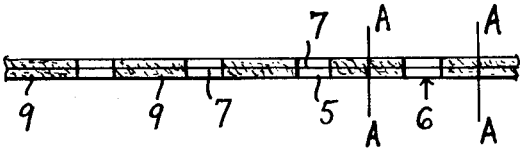
FIG. 3 is a plan view of the assembly shown in FIG. 2.

The fuse element shown in FIG. 1 may be severed from a strip of such fuse elements produced as illustrated in FIGS. 2 and 3. Hence, a strip 6 of insulating material is formed at equal intervals along its length with rebates 5 having a predetermined length dimension. A fine fusible wire 7 is disposed along the length of the strip and is secured to the raised zones or lands 8 at the ends of the rebates 5 by metal layers 9 which are sprayed over the wire where it extends across these zones. For the purposes of facilitating the spraying step, the wire may be temporarily attached to the strip beforehand with the aid of drops of a quick drying adhesive substance applied to the strip in at least some of the zones 8. The metal forming the layers 9 is hot sprayed so as completely to cover the zones 8 and suitable masking may be used to provide for this whilst prohibiting the sprayed metal from depositing in the rebated areas. When cooled the sprayed metal layers adhere the fusible wire 7 to the insulating strip and, thereafter, the strip and wire are severed at the zones 8 and intermediate the ends thereof, such as, along the lines A—A, in order to separate the strip into individual fuse elements of the type shown in FIG. 1.

Figure 4:
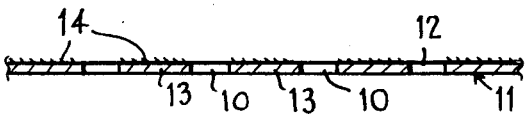
FIG. 4 is a view similar to FIG. 2 illustrating another manufacturing method in accordance with the invention.
Figure 5:
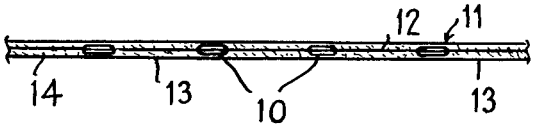
FIG. 5 is a plan view of the assembly shown in FIG. 4.

FIGS. 4 and 5 illustrate another embodiment of this invention in which the fuse element produced have openings or slots between the wire attachment zones, instead of the rebates 5, to prevent the central, fusible sections of their fuse wires from contacting the insulating supports. Such fuse elements are formed from a strip 11 of insulating material, such as paper, having the openings 10 formed therethrough at substantially equally spaced positions along the length of the strip. A fusible wire 12 is disposed along the length of the strip and is secured to the latter at the zones 13 between the openings 10 by spraying metal layers 14, for example, zinc layers, as described in the previous embodiment. Thereafter, the strip is severed at the zones 13, intermediate the openings, in order to separate the strip into individual fuse elements.

Figure 6:
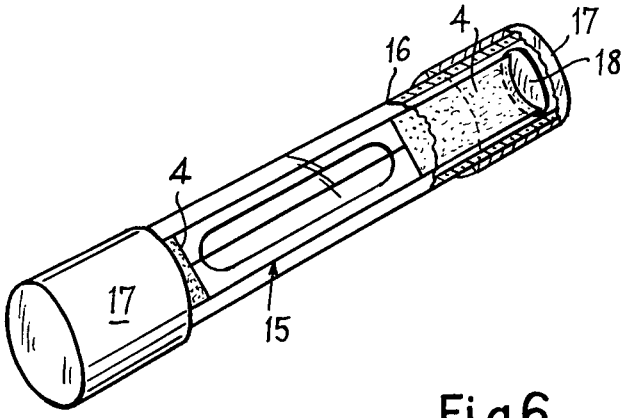
FIG. 6 is a perspective view, partially broken away, of a miniature cartridge fuselink including a fuse element manufactured by the method illustrated in FIGS. 4 and 5.

FIG. 6 illustrates a miniature cartridge fuselink comprising a fuse element 15, produced by the method described with reference to FIGS. 4 and 5, an insulating barrel 16 made from transparent glass or other insulating material, and metal end caps 17. Opposite ends of the fuse element 15 are connected to the inside top surfaces of the caps by solder blobs 18 melted about the element ends and bonded to the metal layers 4. To assemble this fuselink, one cap 17 having a slug of solder adhered to its inside top surface is firstly fastened over one end of the barrel 16 and then the fuse element 15, which is of substantially the same length as the barrel, is inserted into the barrel and its end adjacent the cap is soldered thereto by the application of heat and a light pressure. Thereafter the second cap 17 having a slug of solder adhered to its inside top surface is fastened in position over the opposite end of the barrel with the application of heat and pressure so as to solder the adjacent end of the fuse element to this second end cap.

Whilst particular embodiments have been described, it will be understood that modifications can be made without departing from the scope of the invention as defined by the appended claims.

I claim:

1. In the manufacture of electrical cartridge fuselinks wherein fuse elements are produced by mounting fusible members on insulating supports between conductive end zones of said supports, and said fuse elements are disposed within insulating barrels with said conductive end zones electrically connected to end terminals of said barrels, the improvement which facilitates the rapid and multiple production of said fuse elements comprising the steps of disposing a continuous length of said fusible member along a continous strip of insulating material, adhering metallic layers to said continuous fusible member and strip at spaced attachment zones along said strip to attach said continuous fusible member to said strip, and severing said continuous fusible member and strip at said spaced attachment zones to produce individual ones of said fuse elements.

2. The improvement claimed in claim 1, wherein said metallic layers are produced by applying a coating of fluidized metallic material to said continuous fusible member and strip and solidifying said metallic material.

3. The improvement claimed in claim 1, wherein, prior to the application of said metallic layers, said continuous fusible member is temporarily attached in position to said insulating strip by small amounts of a quick-drying adhesive substance applied to said strip in said spaced attachment zones.

4. The improvement claimed in claim 1, wherein said insulating strip has rebates formed in one side thereof at substantially equally spaced positions along said strip, and said continuous fusible member is adhered to said strip in said spaced zones between said rebates.

5. The improvement claimed in claim 1, wherein said continuous fusible member is a continuous fusible filament and said insulating strip is a continuous strip of paper having elongated openings formed therethrough at substantially equally spaced positions along said paper strip, said openings having a length predetermined in accordance with the required resistance of said fuse elements, and including the steps of applying drops of a quick drying adhesive substance to said paper strip in at least some of the zones between said openings, disposing said continuous fusible filament along said paper strip and temporarily attaching said filament to said strip by means of said adhesive drops, hot spraying metal onto said filament and strip through a mask to apply a metal coating to said wire and strip substantially throughout the length of each zone between said openings for adhering said filament permanently to said strip, cooling said coatings, severing said filament and strip intermediate said openings, and mounting said fuse elements thus produced within said insulating barrels with said metal coatings of each said fuse element soldered to said end terminals of the associated said barrel.

* * * * *